US011751730B2

(12) United States Patent
Chen

(10) Patent No.: US 11,751,730 B2
(45) Date of Patent: Sep. 12, 2023

(54) MULTI-SURFACE CLEANING TOOL

(71) Applicant: Yong S. Chen, Glendora, CA (US)

(72) Inventor: Yong S. Chen, Glendora, CA (US)

( * ) Notice: Subject to any disclaimer, the term of this patent is extended or adjusted under 35 U.S.C. 154(b) by 221 days.

(21) Appl. No.: 17/017,505

(22) Filed: Sep. 10, 2020

(65) Prior Publication Data

US 2021/0076887 A1 Mar. 18, 2021

Related U.S. Application Data

(60) Provisional application No. 62/901,190, filed on Sep. 16, 2019.

(51) Int. Cl.
*A47K 11/10* (2006.01)
*A46B 5/00* (2006.01)

(52) U.S. Cl.
CPC ..... *A47K 11/10* (2013.01); *A46B 5/0012* (2013.01); *A46B 2200/304* (2013.01)

(58) Field of Classification Search
CPC ..... A46B 5/0012; A46B 5/0033; A46B 5/005; A46B 5/0058; A46B 7/02; A46B 7/023; A46B 2200/304; A47K 11/10
USPC ..... 15/164, 165, 201
See application file for complete search history.

(56) References Cited

U.S. PATENT DOCUMENTS

| | | | | |
|---|---|---|---|---|
| 1,660,318 | A | 2/1928 | Anderson | |
| 1,758,632 | A | 5/1930 | Wagner | |
| 2,232,269 | A | 2/1941 | Reuben | |
| 4,967,441 | A | 11/1990 | White | |
| 5,440,775 | A | 8/1995 | Banks | |
| 5,878,459 | A | 3/1999 | McPartland | |
| 6,463,620 | B2 | 10/2002 | Busha | |
| 6,804,839 | B1 | 10/2004 | McMaster | |
| 7,424,764 | B2 | 9/2008 | Trenz et al. | |
| 9,113,758 | B1 * | 8/2015 | O'Brien | A47K 11/10 |
| 9,943,197 | B2 | 4/2018 | Shabat | |
| 2004/0088808 | A1 * | 5/2004 | Vitantonio | A47K 17/00 15/210.1 |
| 2012/0030889 | A1 * | 2/2012 | Pannell | A47L 13/08 15/111 |
| 2020/0015583 | A1 * | 1/2020 | Mart | A47K 11/10 |

* cited by examiner

*Primary Examiner* — Laura C Guidotti
*Assistant Examiner* — Aaron R McConnell
(74) *Attorney, Agent, or Firm* — Kirk A. Buhler; Buhler & Associates Patenting

(57) ABSTRACT

Improvements in a cleaning brush is disclosed. The cleaning tool has both a larger and smaller cleaning feature a single size cleaning tool to try and cover all uses is obviated. With a larger cleaning head, the larger cleaning head can be optimized for the rim surfaces of a toilet. The inner detailing head retracts into the outer cleaning tool. In the retracted mode the detailing head operates with the larger outer tool and provides a cohesive flat surface for cleaning. A spring can be used to retract the detailing head. The detailing head extends from the center, side or corner of the cleaning tool and extends far enough to allow for full use of the detailing head to effectively reach corners and/or cervices. The handle and or the head can be angled to provide an optimum angle for use.

18 Claims, 7 Drawing Sheets

MULTI-SURFACE CLEANING TOOL

CROSS REFERENCE TO RELATED APPLICATIONS

This application claims the benefit of Provisional Application Ser. No. 62/901,190 filed Sep. 16, 2019 the entire contents of which is hereby expressly incorporated by reference herein.

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC

Not Applicable

BACKGROUND OF THE INVENTION

Field of the Invention

This invention relates to improvements in a cleaning brush. More particularly, the present multi-surface cleaning tool has a brush with detailing head or rotating head that has a brush head that provides cleaning of larger areas and an internal smaller head or surface that can be extended or rotated from to provide detailed cleaning to corners or smaller areas.

Description of Related Art Including Information Disclosed Under 37 CFR 1.97 and 1.98

Toilets, sinks, car rims and other surfaces require regular cleaning to maintain cleanliness and removal of germs. Cleaning of toilets and bathrooms require the use of chemicals and a scrubbing or brushing device. The person cleaning the toilet sink, car rim or other surface will use chemicals on the surface or on the cleaning tool and then brush or scrub the surface to clean, eliminate odor and bacteria. One problem with using a single cleaning brush or pad is that the brush or pad is too large to clean small cervices and cracks with a single tool to clean both the large and detail areas of the surface that is being cleaned. A number of patents and or publications have been made to address these issues. Exemplary examples of patents and or publication that try to address this/these problem(s) are identified and discussed below.

U.S. Pat. No. 6,804,839 issued on Oct. 19, 2004 to Randy McMaster and is titled Combination Toilet Brush/Plunger Apparatus. This patent discloses a combination toilet brush/plunger apparatus for providing both a plunger and a toilet cleaning brush in one convenient unit. The combination toilet brush/plunger apparatus includes a brush assembly including a brush support member, and also including a brush member being attached to the brush support member. While this combination tool has a cleaning brush the size of the brush does not allow for cleaning small corners and details.

U.S. Pat. No. 5,440,775 issued on Aug. 15, 1995 to Katherine L. Banks and is titled Toilet Bowl Scrubber. This patent discloses a toilet bowl scrubber having a handle with a linear configuration, a first brush connected to one end of the handle, an arm extending outwardly of the handle between the first brush and an opposite end of the handle, and a second brush affixed to an end of the arm opposite the handle. The first brush has tufts of bristles affixed thereto extending perpendicular to a longitudinal axis of the handle. The arm includes a first arm portion extending outwardly perpendicular to the handle and a second arm portion extending in a direction from the first arm portion away from the first brush. While this patent discloses both a large area brush and a smaller detail brush, they are separate elements that extend or rotate from the handle.

U.S. Pat. No. 5,878,459 issued on Mar. 9, 1999 to Kelly McPartland and is titled Toilet Brush. This patent discloses a toilet brush having a handle portion and a scrubbing portion is provided. A flexible connection is provided between the handle portion and the scrubbing portion. A deflection limiter is located in proximity to the connection which limits deflection of the scrubbing portion in a first direction relative to the handle portion. This patent has a brush with both sides for different purposes, but does not include a detailed tool for cleaning small areas.

What is needed is brush with a detailing head that extends or rotates from the brush. The proposed multi-surface cleaning tool provides the solution with a brush that has an inner tool that extends from the brush or can be rotated from the handle to allow the tool to cleans smaller areas and corners.

BRIEF SUMMARY OF THE INVENTION

It is an object of the multi-surface cleaning tool to provide a tool for cleaning surfaces and areas such as toilets, bathroom surfaces, sinks and vehicle rims. Bathroom and toilet surfaces require a variety of tools to clean the various surfaces, areas, corners and cervices. The brush has a handle that extends from the rear to enable a user to reach into areas from a distance and further reduces the potential for the splatter to reach beyond the distance of the handle. The handle may also be extendable to vary the distance from the user to the cleaning surface.

It is an object of the multi-surface cleaning tool to have an outer head. The outer head is configured to quickly cover larger surfaces of cleaning. Because the cleaning tool has both a larger and smaller cleaning feature a single size cleaning tool to try and cover all uses is obviated. With a larger cleaning head, the larger cleaning head can be optimized for the rim surfaces of a toilet, sink corners or in and around the rims of a vehicle, tires and spokes.

It is an object of the multi-surface cleaning tool to provide a tool with a rotating head. The rotating head allows the user to select from more than one cleaning head and places the optimal tool at an angle that allows the user to assert pressure on the handle and cleaning pad to clean a variety of surfaces and areas.

It is another object of the multi-surface cleaning tool to have an inner detailing tool. The inner detailing tool is specifically designed to reach corners and cavities that would be difficult to reach with a larger size head. In particular, corners that join at 90 degrees can be difficult reach, the detailing tool is tapered to reach these corners from a distance at the end of the handle.

It is still another object of the multi-surface cleaning tool for the inner detailing head to retract into the outer cleaning tool. In the retracted mode the detailing head operates with the larger outer tool and provides a cohesive flat surface for cleaning. A spring can be used to retract the detailing head. The detailing head extends from the center, side or corner of the cleaning tool and extends far enough to allow for full use of the detailing head to effectively reach corners and/or cervices.

It is still another object of the multi-surface cleaning tool for the major head and/or the inner detailing head to be angled. The angle allows the tool to reach under a toilet rim to areas that may not be visible and may not be accessible with a straight shaft. The handle and or the head can be angled to provide an optimum angle for use.

Various objects, features, aspects, and advantages of the present invention will become more apparent from the following detailed description of preferred embodiments of the invention, along with the accompanying drawings in which like numerals represent like components.

BRIEF DESCRIPTION OF THE SEVERAL VIEWS OF THE DRAWING(S)

DETAILED DESCRIPTION OF THE INVENTION

Figure 1:
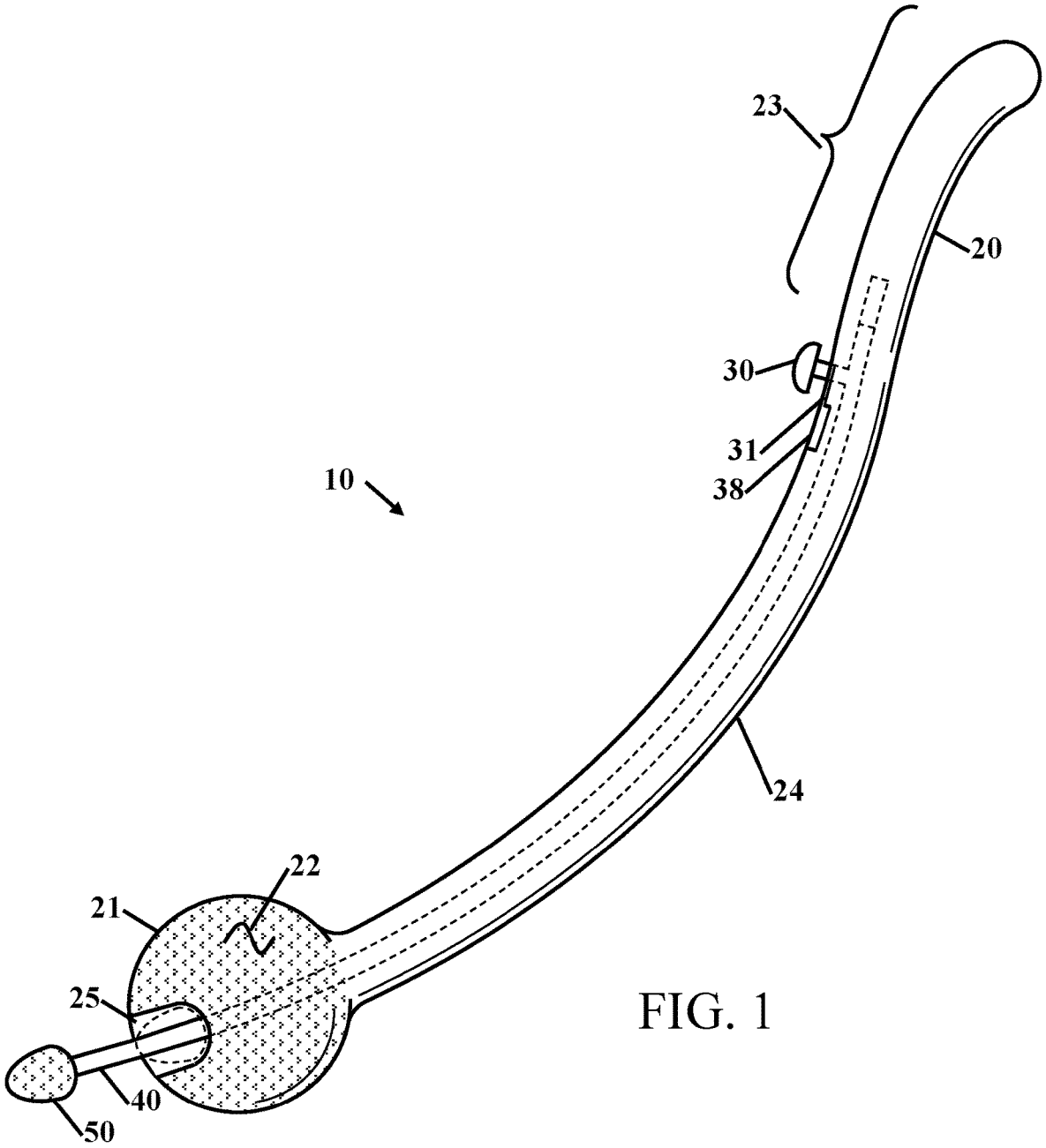
FIG. 1 shows a perspective view of a brush with detailing head.

It will be readily understood that the components of the present invention, as generally described and illustrated in the drawings herein, could be arranged and designed in a wide variety of different configurations. Thus, the following more detailed description of the embodiments of the system and method of the present invention, as represented in the drawings, is not intended to limit the scope of the invention, but is merely representative of various embodiments of the invention. The illustrated embodiments of the invention will be best understood by reference to the drawings, wherein like parts are designated by like numerals throughout.

| Item Numbers and Description | |
|---|---|
| 10 brush with detailing head | 19 toilet |
| 20 upper handle | 21 first larger cleaning head |
| 22 scrubber | 23 handle |
| 24 outer shaft | 25 cavity |
| 26 end | 27 lower spring seat |
| 30 button | 31 upper slot |
| 32 side stops | 33 spring |
| 34 rod | 35 vertical tab |
| 36 guide rod | 37 upper spring seat |
| 38 lower slot | 40 inner shaft |
| 50 second cleaning head | 50 L/50 R left, right head travel |
| 60 rotate body | 61 scrubber |
| 62 pivot axis | 63 first lock detent |
| 64 second lock detent | 65 narrow cleaning head |
| 66 broad cleaning head | 70 narrow cleaning head |
| 71 wide cleaning head | 72 pivot |
| 73 pivot | 74 pivot |
| 75 pivot | 76 moving rod |
| 77 movable inner shaft | 80 larger cleaning head |
| 81 smaller detail head | 82 larger first end |
| 83 smaller second end | 84 slot |
| 85 pivot | 86 pivot |
| 87 arm | 88 rotating body |
| 95 rotate | 96 slide |
| 97 left | 98 right |
| 99 move | |

FIG. 1 shows a perspective view of a brush with detailing head 10. The brush with detailing head 10 can have a first larger cleaning head 21 as a porous sponge type head, can have bristles, or a scrubber 22 but can have a hybrid. The first larger cleaning head 21 can also be replaceable. Within the first larger cleaning head 21 is a second cleaning head 50. A handle with a has an outer shaft 24. Within the outer shaft 24 is an inner shaft 40. At a first end of the inner shaft 40 is a button 30, at a second end of the inner shaft 40 is a second cleaning head 50. The second cleaning head 40 retracts within a cavity 25 that allows the first larger cleaning head 21 to be essentially a continuous ball or pad. Due to the size and shape of the larger cleaning head 21 the ability to clean in corners is limited. The second cleaning head 50 can be extended out of the cavity 25 to clean corners and details. Extending the second cleaning head is activated from the upper handle 20.

The upper handle 20 connects to the first larger cleaning head is with an outer shaft 24 that provides a distance from the user to the first larger cleaning head 21. A user grips the handle 23 to use the brush with detailing head 10. As a user grips the handle 23, the user can place a thumb or other digit onto the button 30. The button 30 can then be pushed downward from the upper slot 31 to the lower slot 38 where the user can extend and articulate the second cleaning head 50 when it is extended to clean areas and details that are too small for the first larger cleaning head 21. The lower slot 38 is wider than the upper slot 31 and the user can articulate or wiggle the button side-to-side to use the second cleaning head 50 to scrub a particular area of the toilet, bathroom, sink, car rim or other area that is being cleaned. Greater detail of the different components of the brush with detailing head 10 are shown and described in other figures herein.

Figure 2A:
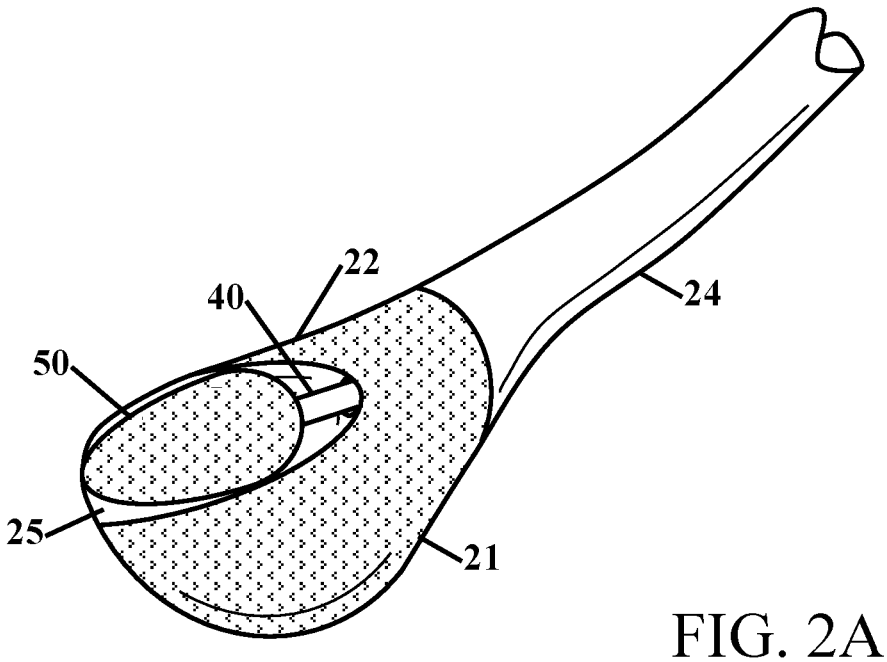
FIG. 2A shows a perspective view of the cleaning heads in a retracted orientation.
Figure 2B:
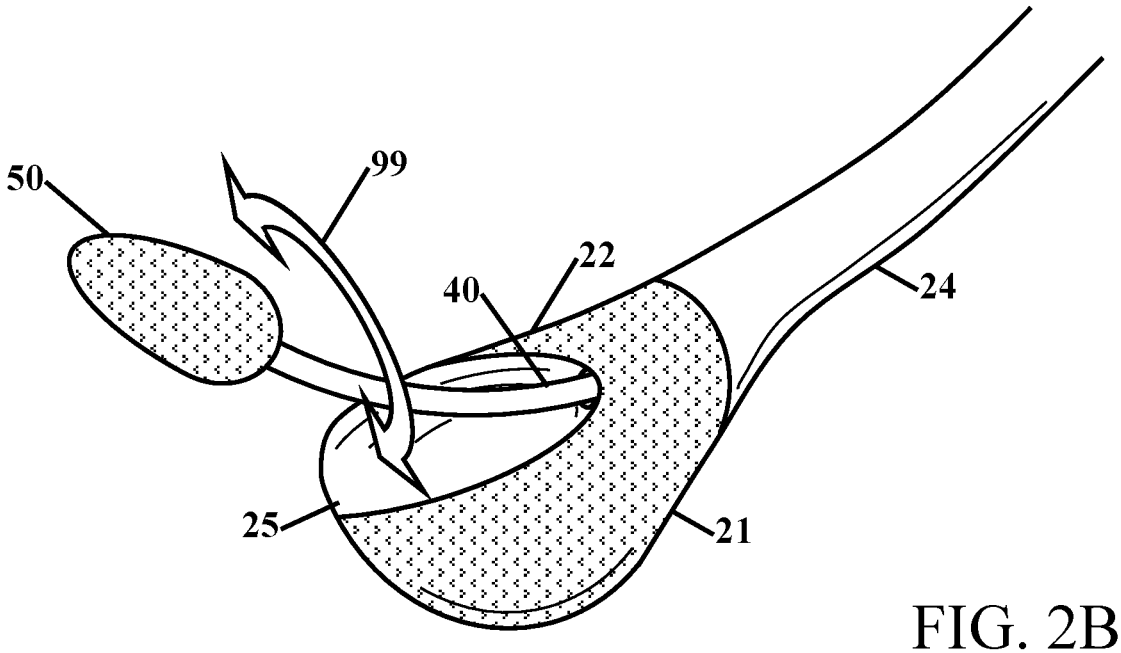
FIG. 2B shows a perspective view of the cleaning heads with the detailing head extended.

FIG. 2A shows a perspective view of the cleaning heads 21 and 50 in a retracted orientation and FIG. 2B shows a perspective view of the cleaning heads with the detailing head 50 extended. In FIG. 2 the second cleaning head 50 sits essentially within the cavity 25 of the first larger cleaning head 21 and exist on the end of the outer shaft 24. In this configuration the combined cleaning heads provide a continuous surface to clean flat or slightly rounded surfaces. While the cleaning pads are shown to form a rounded surface, it is contemplated that they can be formed in with a flatter outer surface with flat or rounded edges. The first larger cleaning head 21 can be a porous sponge surface or can be a scrubber with bristles. The detail or second cleaning head 50 is shown secured to the inner shaft 40. While the second cleaning head 50 is shown and/or described as moving out of the cavity 25 at a particular location, the cavity 25 can be in the center of the first larger cleaning head 21, eccentric of the first larger cleaning head 21 or on any side of the first larger cleaning head 21.

The second cleaning head 50 curves out on the inner shaft 40 as shown in FIG. 3. The curvature allows the second cleaning head 50 to be move 99 side-to side to clean corners and cervices. If the second cleaning head 50 simply extended straight from the cavity 25, the second cleaning head 50 would only rotate and would not be able to perform side-to-side brushing or cleaning. The inner shaft 40 is a compliant material that can flex based upon loads on the second cleaning head 50. When the second cleaning head 50 is placed into a corner, movement 99 may only result in rotational cleaning. The mechanical control of the inner shaft on the second cleaning head 50 is shown and described with other figures herein.

Figure 3A:
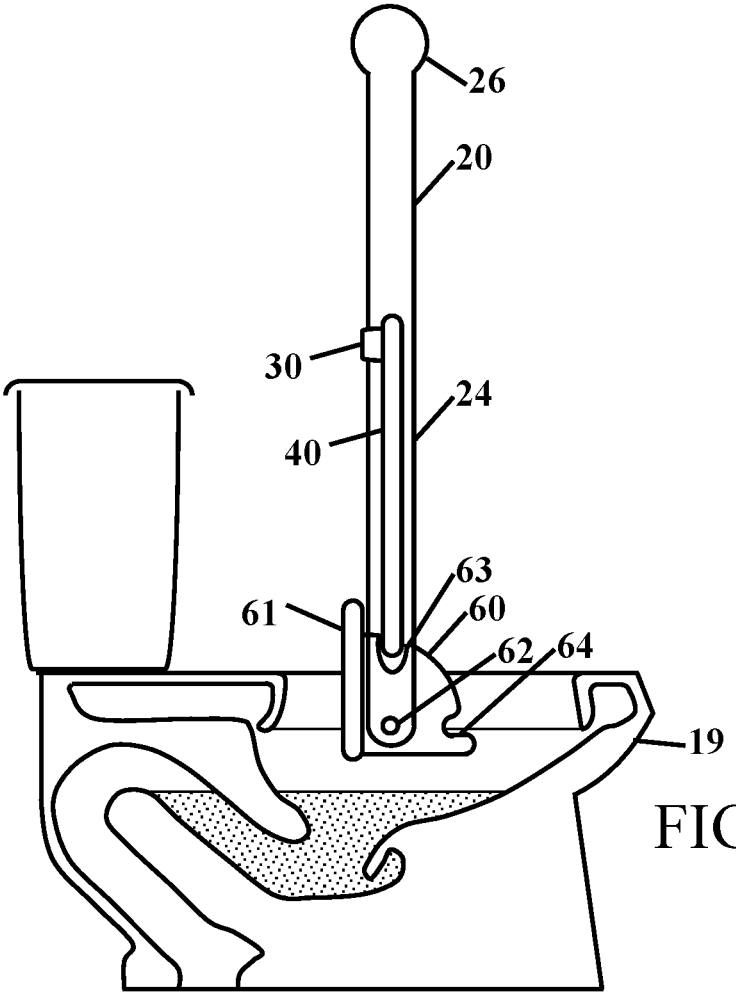
FIG. 3A shows a side view of a rotating cleaning head in a first orientation.
Figure 3B:
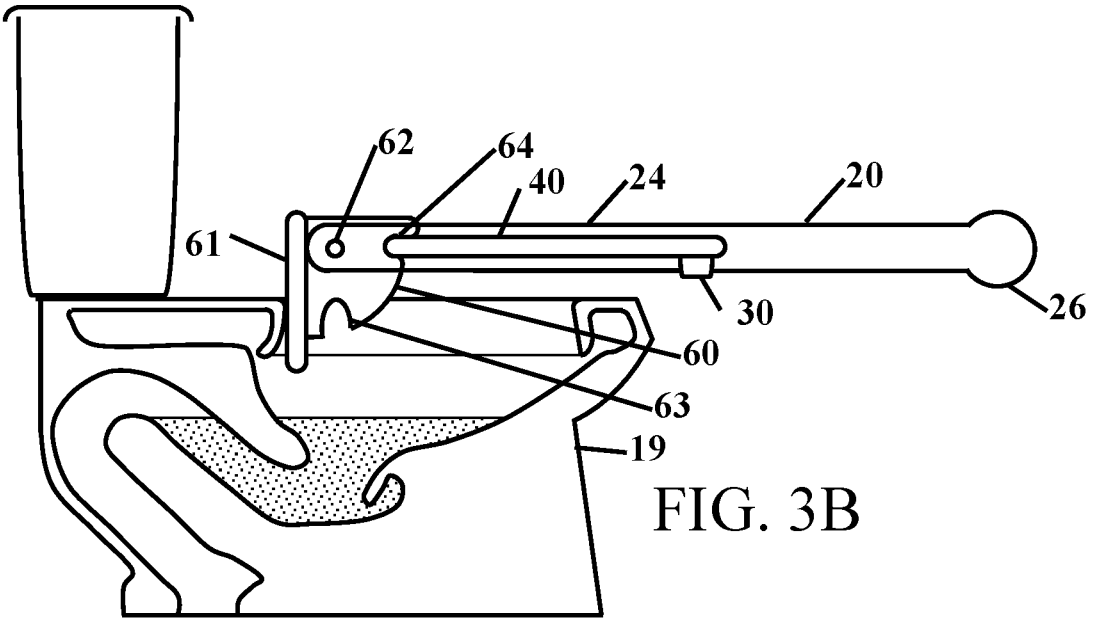
FIG. 3B shows a side view of a rotating cleaning head in a second orientation.

FIG. 3A shows a side view of a rotating cleaning head in a first orientation and FIG. 3B shows a side view of a rotating cleaning head in a second orientation. In the next two figures, the cleaning head is shown cleaning a toilet, but the surface that is being cleaned can be a sink, floor, refrigerator, car tire or other surface. This cleaning tool has a rotating body 60. The rotating body rotates from a pivot point 62. The rotation is stopped by the inner shaft 40 when the inner shaft 40 engages into a first lock detent 63 or a second lock detent 64. This embodiment has a scrubber 61 surface on the bottom and other surfaces that can be inserted into other areas for cleaning details. This embodiment has a combination of larger and narrow cleaning surfaces and features to clean within deep areas as well as flat surfaces. This is a single tool that can be used on a toilet, sink corners or in and around the rims of a vehicle, tires and spokes. To change orientations of the rotating body 60 the user can lift the button 30 that raises the inner shaft 40. The user can then use gravity or friction to roll the rotating body 60 to another position and then release the button 30 that will lock the inner shaft 40 into detent 63 or detent 64.

Figure 4A:
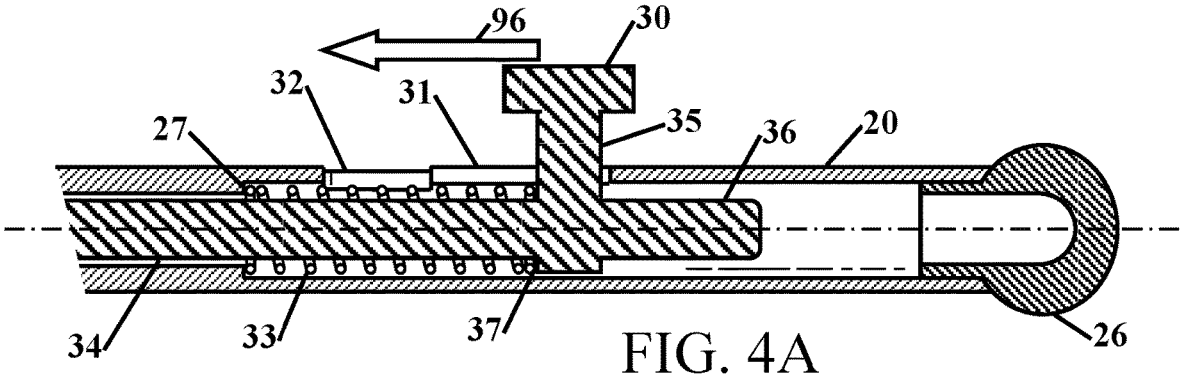
FIG. 4A shows a sectional side view of the button control mechanism.

FIG. 4A shows a sectional side view of the button 30 control mechanism. In the upper handle 20, a user can grip the upper handle 20 in a single hand and place a thumb onto the button 30 to control the second cleaning head 50 (not shown in this figure). A user can place a thumb onto the button 30 and slide 96 the button forward to extend the second cleaning head. A vertical tab 35 connects the button 30 to a rod 34 that connects, or is the inner shaft 40. A spring 33 biases the inner rod 34 in the retracted orientation that maintains the second cleaning head 50 within the first larger cleaning head 21. The spring 33 is restrained on a first side on the lower spring seat 27 and on a second side on an upper spring seat 27.

The vertical tab 35 allows movement of the button 30 in an upper slot 31 and in a lower slot that has side stop(s) 32. The lower slot is wider than the upper slot 31 and allows a user to move the button 30 side-to-side to articulate the second cleaning head 50. The rear of the inner rod 34 has a guide rod 36 that maintains a concentric relationship of the inner rod 34 and guide rod 36 within the upper handle 20. An end 26 cap or plug encloses the end of the assembly and further is enlarged in size to reduce the possibility that the upper handle 20 can slide out of a hand.

Figure 4B:
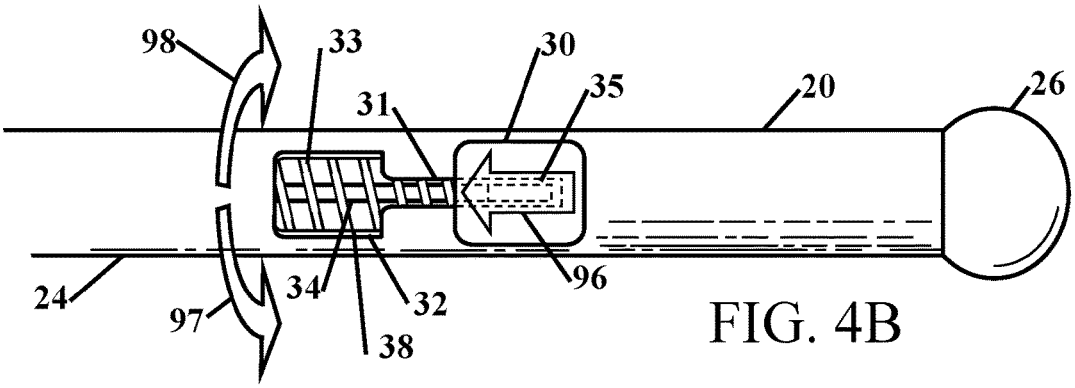
FIG. 4B shows a top view of the button control mechanism.

FIG. 4B shows a top view of the button 30 control mechanism. Starting from the right side of this figure the end 26 cap is shown secured to the upper handle 20. The upper handle 20 is hollow to provide clearance for the interior mechanism. The button 30 is shown on the vertical tab 35 and centered in the upper slot 31. Portions of the spring 33 is visible through the window of the upper slot 31 and the lower slot 38. The rod 34 is shown under the spring 33 and within the upper handle 20 as the rod passes into the outer shaft 24.

The user can grasp the upper handle 20 and comfortably place their thumb onto the button 30. The user can then slide 96 the button 30 down to overcome the forces of the spring 33 to move the button 30 out of the upper slot 31 and into the lower slot 38. The lower slot 38 is wider than the upper slot 31 and the user can move the button 30 left 97 and right 98 to articulate the second cleaning head 50 (not shown in this figure) that is connected to the rod 34. The lower slot 38 has side stops 32 to limit the side-to-side motion. The side-to-side motion of the second cleaning head 50 is shown in other figures herein.

Figure 4C:
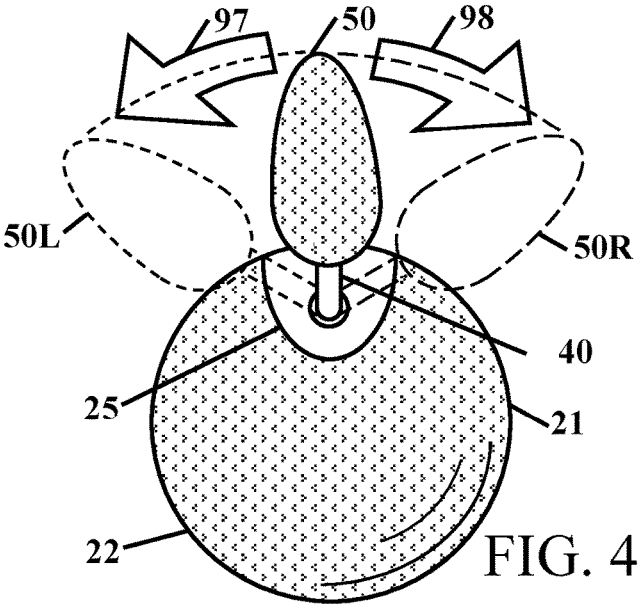
FIG. 4C shows a front view of the cleaning heads and articulation of the detailing head.

FIG. 4C shows a front view of the cleaning heads and articulation of the detailing head or the second cleaning head 50. The second cleaning head 50 is shown extended from the cavity 25 of the first larger cleaning head 21. The first larger cleaning head 21 can have a scrubbing surface 22 for more aggressive cleaning and can be treated with cleaning products and/or can be replaceable. The second cleaning head 50 is shown on the shaft 40 as it extends from the cavity 25. The inner shaft 40 is a compliant material that can flex based upon loads on the second cleaning head 50. When the previously identified button 30 moves in the upper slot 31 (both not shown in this figure), the second cleaning head 50 extends straight out of the cavity 25. When the button 30 enters the lower slot 38 (shown in other figures) the button can be moved left and right to impart the left 97 and right 98 movement to the second cleaning head 50 and will result in the left head travel of the second cleaning head 50 to 50L and right head travel to the second cleaning head 50 to 50R. This allows the second cleaning head 50 to clean an area without movement to the upper handle.

Figure 5A:
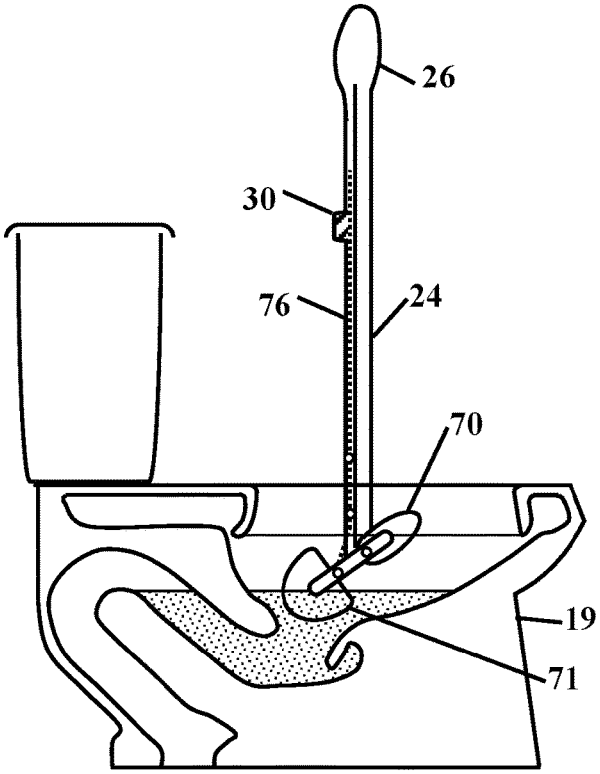
FIG. 5A shows a side view of a second embodiment of a rotating cleaning head in a first orientation.
Figure 5C:
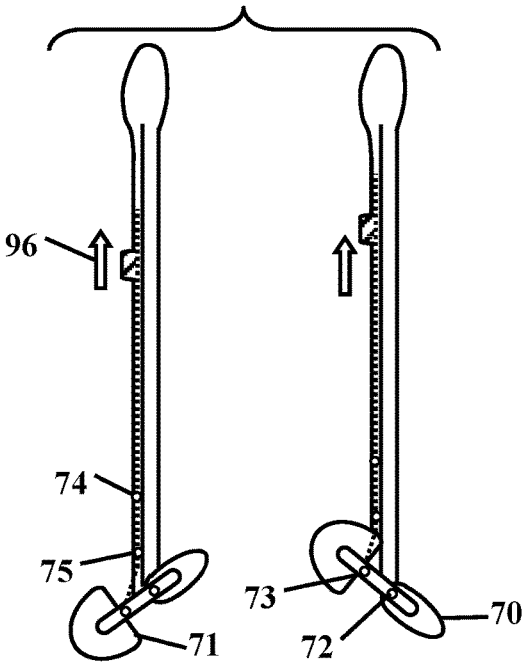
FIG. 5C show the rotating cleaning head in a second orientation.
Figure 5B:
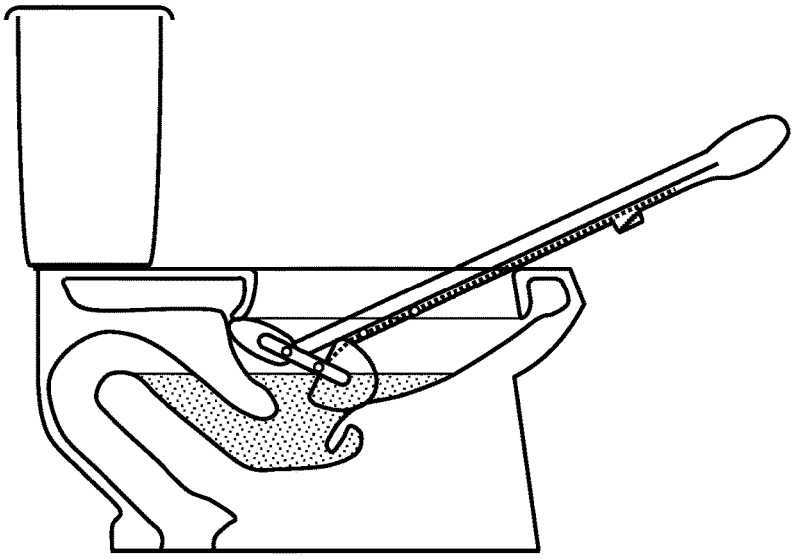
FIG. 5B shows a side view of the second embodiment of the rotating cleaning head in a second orientation.

FIG. 5A shows a side view of a second embodiment of a rotating cleaning head in a first orientation, FIG. 5B shows a side view of the second embodiment of the rotating cleaning head in a second orientation and FIG. 5C show the rotating cleaning head in a second orientation. In the next figures, the cleaning head is shown cleaning a toilet, but the surface that is being cleaned can be a sink, floor, refrigerator, car tire or other surface. This cleaning tool has a rotating body with two cleaning heads 70 and 71. The rotating body rotates from a pivot points 72 and 73. This embodiment has a combination of larger 71 and narrow 70 cleaning surfaces and features to clean within deep areas as well as flat surfaces. To change orientations of the rotating body the user can slide 96 the button 30 that raises the moving rod 76. The moving rod 76 has pivots 74 and 75 that allows the moving rod to flex, bend or pivot to change between the two cleaning heads 70 and 71.

Figure 6:
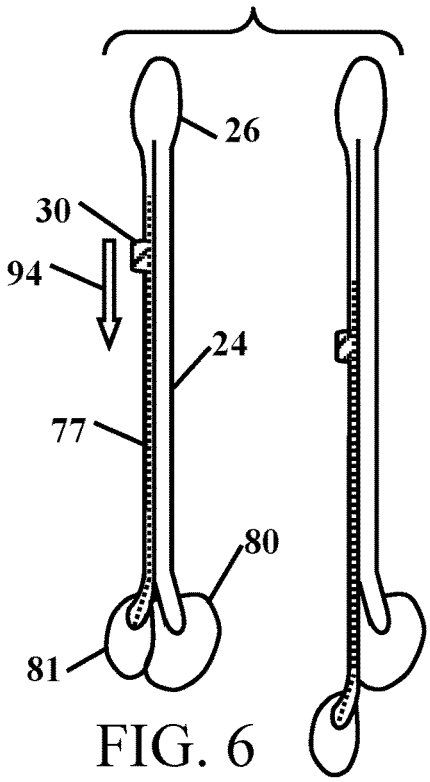
FIG. 6 show a third embodiment of the movable detail cleaning head.

FIG. 6 show a third embodiment of the movable detail cleaning head. The brush with detailing head 81 can have a first larger cleaning head 80 as a porous sponge type head, can have bristles, or a scrubber but can have a hybrid. The handle 26 has a fixed outer shaft 24. Within the outer shaft 24 is a movable inner shaft 77. At a first end of the movable inner shaft 77 is a button 30, at a second end of the movable inner shaft 77 is a smaller detail head 81. The detailing head 81 retracts to a position that is adjacent to the first larger cleaning head 80. Due to the size and shape of the larger cleaning head 80 the ability to clean in corners is limited. Extending the second smaller detail head 81 is activated from the upper portion of the handle 20. A user grips the handle end 26, as a user grips the handle, the user can place a thumb or other digit onto the button 30. The button 30 can then be pushed downward 94 where the user can extend and articulate the second smaller detail head 81.

Figure 7:
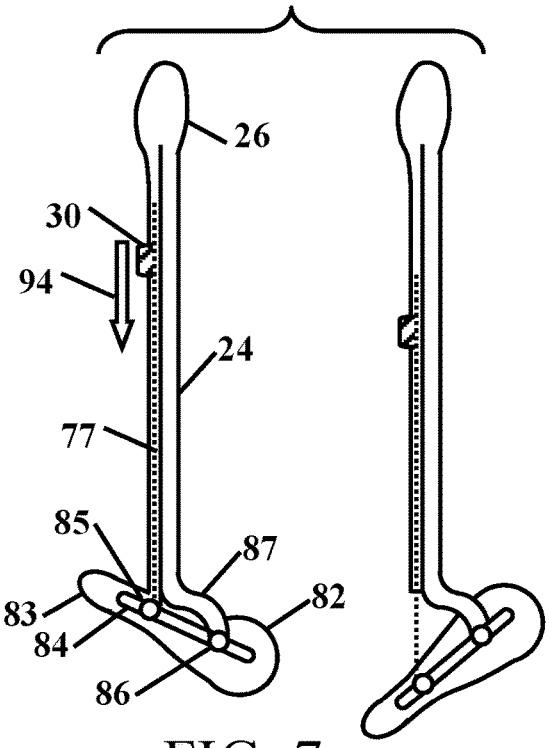
FIG. 7 shows a fourth embodiment of a rotating cleaning head.

FIG. 7 shows a fourth embodiment of a rotating cleaning head. In this embodiment the dual cleaning head has a larger first end 82 and a smaller second end 83. The outer shaft 24 is essentially fixed and pivot point 86 allows the rotating cleaning head to pivot on the pivot point 86. The end of the fixed outer shaft 24 has an offset arm 87. The offset arm 87 can take a variety of shapes. One contemplated shape is shown in this figure. When the button 30 is moved down 94 it pushes movable inner shaft 77 down and pivots 85 in the slot 84 to move the smaller second end 83 of the cleaning head downward to allow use of the smaller second end 83 into a position for use.

Figure 8:
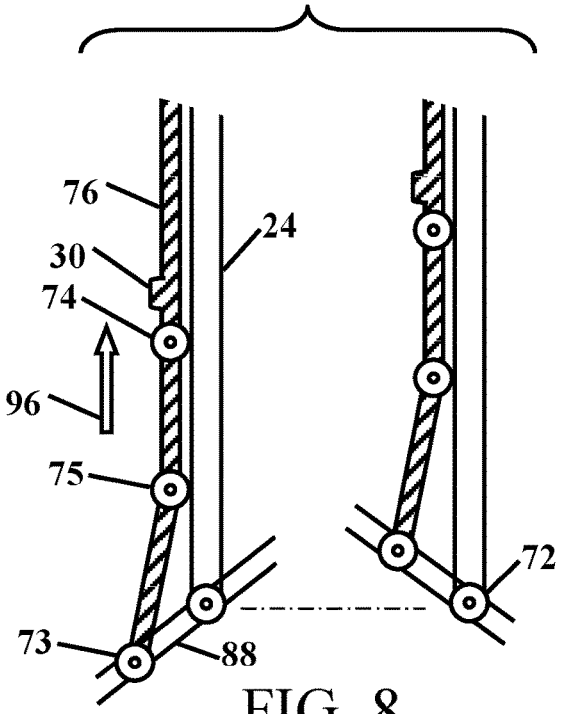
FIG. 8 shows a fifth embodiment of a rotating cleaning head.

FIG. 8 shows a fifth embodiment of a rotating cleaning head. This cleaning tool has a rotating body 88 with two ends for cleaning heads. The rotating body rotates from a pivot points 72 and 73. To change orientations of the rotating body 88 the user can slide 96 the button 30 that raises the moving rod 76. The moving rod 76 has pivots 74 and 75 that allows the moving rod to flex, bend or pivot to change between the two cleaning heads.

Figure 9:
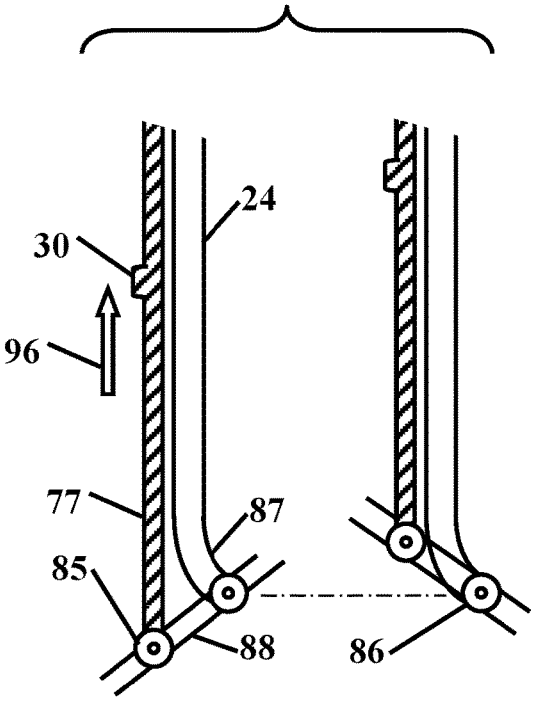
FIG. 9 shows a sixth embodiment of a rotating cleaning head.
Figure 10:
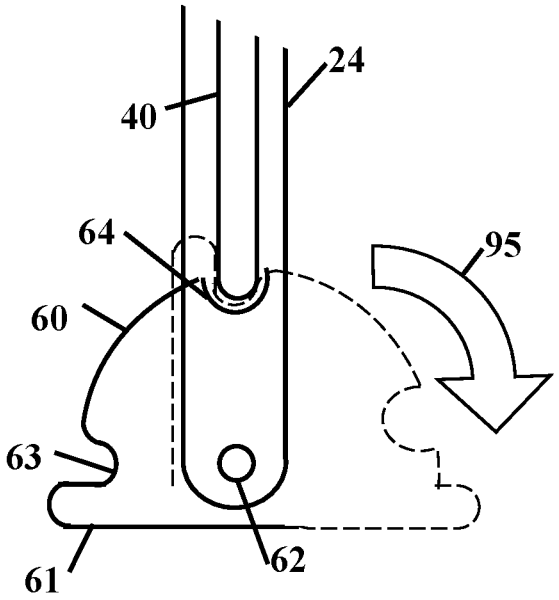
FIG. 10 shows a detailed side view of the rotating cleaning head.

FIG. 9 shows a sixth embodiment of a rotating cleaning head. In this embodiment the rotating body 88 with two ends for cleaning heads. The outer shaft 24 is essentially fixed and pivot point 86 allows the rotating cleaning head to pivot on the pivot point 86. The end of the fixed outer shaft 24 has an offset arm 87. When the button 30 is moved 96 it pushes movable inner shaft 77 and pivots 85 to move the rotating body 88 of the cleaning head FIG. 10 shows a detailed side view of the rotating cleaning head. This cleaning tool has a rotating body 60. The rotating body rotates from a pivot point 62. The rotation is stopped by the inner shaft 40 when the inner shaft 40 engages into a first lock detent 63 or a second lock detent 64. To change orientations of the rotating body 60 the user can lift the button 30 that raises the inner shaft 40. The user can then use gravity or friction to roll the rotating body 60 to another position and then release the button 30 that will lock the inner shaft 40 into a detents 63 or 64. In the embodiment shows there are two detents 63 and 64, but more than two detents are contemplated to provide additional rotations to lock the rotating body 60. In addition, while the rotating body is shown with rotations of 90 degrees, the rotation can be less or more than 90 degrees.

Figure 11:
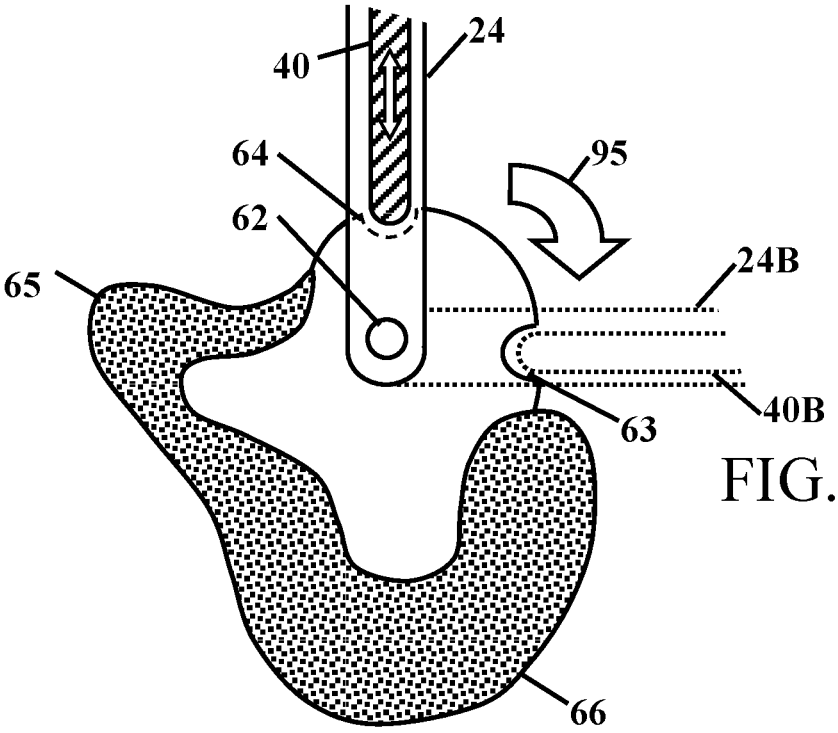
FIG. 11 shows a side view of another embodiment of a rotating cleaning head.

FIG. 11 shows a side view of another embodiment of a rotating cleaning head. This cleaning tool has a rotating body with a broad cleaning head 66 and a narrow cleaning head 65. The rotating body rotates from a pivot point 62. The rotation is stopped by the inner shaft 40 when the inner shaft 40 engages into a second lock detent 64 or a second lock detent 63. To change orientations of the rotating body the user can lift the button (not shown in this figure) that raises the inner shaft 40. The user can then use gravity or friction to roll the rotating body to another position and then release the button that will lock the inner shaft 40 into a detents 63 or 64. In the embodiment shows there are two detents 63 and 64, but more than two detents are contemplated to provide additional rotations to lock the rotating body 60. In addition, while the rotating body is shown with rotations of 90 degrees, the rotation can be less or more than 90 degrees.

Thus, specific embodiments of a brush with detailing head have been disclosed. It should be apparent, however, to those skilled in the art that many more modifications besides those described are possible without departing from the inventive concepts herein. The inventive subject matter, therefore, is not to be restricted except in the spirit of the appended claims.

SEQUENCE LISTING

Not Applicable.

The invention claimed is:

1. A brush with detailing head comprising:
   an elongated outer shaft connected to a first cleaning head;
   said elongated outer shaft having an internal shaft;
   said internal shaft is connected to a second cleaning head that is retractable into at least a portion of said first cleaning head;
   and said second cleaning head is controlled with a button on said internal shaft that extends second cleaning head out of said first cleaning head;
   said button is constrained in a slot having a first position that retracts said second cleaning head in said first cleaning head and a second position wherein said second cleaning head is extended;
   wherein said button is configured to allow side-to-side movement of said second cleaning head independent of movement of said first cleaning head;
   said second position is a wider slot on both sides of said first position slot, and
   said second position has two side stops that limit side-to-side motion of said second cleaning head.

2. The brush with detailing head according to claim 1, further includes a spring that retracts said second cleaning head into said first cleaning head.

3. The brush with detailing head according to claim 2, wherein said side stops are configured to lock said second cleaning head in an extended orientation with said spring being compressed.

4. The brush with detailing head according to claim 3, wherein said side stops hold said second cleaning head and at an angle from said first cleaning head.

5. The brush with detailing head according to claim 2, wherein said spring is a compression spring.

6. The brush with detailing head according to claim 5, wherein said compression spring at least partially surrounds said internal shaft.

7. The brush with detailing head according to claim 2, wherein said elongated outer shaft has an internal spring seat.

8. The brush with detailing head according to claim 2, wherein said internal shaft has a spring seat.

9. The brush with detailing head according to claim 1, wherein when said second cleaning head is extended said button is articulatable to move said second cleaning head left and right relative to said first cleaning head.

10. The brush with detailing head according to claim 1, wherein said button is at least partially guided in a slot.

11. The brush with detailing head according to claim 1, wherein said side stops are configured to lock said second cleaning head in an extended orientation from said first cleaning head and at an angle from said first cleaning head.

12. The brush with detailing head according to claim 1, wherein said first cleaning head has at least one of bristles, sponge, porous surface or a scrubber.

13. The brush with detailing head according to claim 1, wherein said second cleaning head has at least one of bristles, sponge, porous surface or a scrubber.

14. The brush with detailing head according to claim 1, wherein said second cleaning head is smaller in size from said first cleaning head.

15. The brush with detailing head according to claim 1, wherein said inner shaft is flexible.

16. The brush with detailing head according to claim 1, wherein said button is wider than said first slot.

17. The brush with detailing head according to claim 1, wherein said button is configured to allow side-to-side movement of said second cleaning head independent of movement of said elongated outer shaft.

18. The brush with detailing head according to claim 1, wherein said inner shaft is configured to allow second cleaning head to curve out and away from said first cleaning head as said second cleaning head is extended from said first cleaning head.

* * * * *